US006277551B1

(12) United States Patent
Vandenbroucke

(10) Patent No.: US 6,277,551 B1
(45) Date of Patent: Aug. 21, 2001

(54) EMULSION, MATERIAL AND SCREEN/FILM SYSTEM FOR RADIOLOGICAL IMAGE FORMATION

(75) Inventor: Dirk Vandenbroucke, Boechout (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/492,849

(22) Filed: Jan. 27, 2000

Related U.S. Application Data

(60) Provisional application No. 60/127,148, filed on Mar. 31, 1999.

(30) Foreign Application Priority Data

Feb. 2, 1999 (EP) ..... 99200295

(51) Int. Cl.[7] ..... G03C 1/005

(52) U.S. Cl. ..... 430/567; 430/569; 430/966; 430/605

(58) Field of Search ..... 430/567, 569, 430/966, 604, 605

(56) References Cited

U.S. PATENT DOCUMENTS

| | | | | |
|---|---|---|---|---|
| 5,616,446 | | 4/1997 | Miura et al. . | |
| 5,728,517 | * | 3/1998 | Bryant et al. | 430/567 |
| 5,736,310 | * | 4/1998 | Chen et al. | 430/567 |
| 5,792,601 | * | 8/1998 | Edwards et al. | 430/567 |
| 5,811,229 | * | 9/1998 | Van den Zegel | 430/517 |
| 6,048,096 | * | 4/2000 | Verbeeck et al. | 378/182 |

FOREIGN PATENT DOCUMENTS

| | | | |
|---|---|---|---|
| 542354 | * | 5/1993 | (EP) . |
| 0 890 873 | | 1/1999 | (EP) . |
| WO 91/10166 | | 7/1991 | (WO) . |

OTHER PUBLICATIONS

Research Disclosure 36544, Section I, D. (pp. 504 and 505), Sep. 1994.*

* cited by examiner

*Primary Examiner*—Janet Baxter
*Assistant Examiner*—Amanda C. Walke
(74) *Attorney, Agent, or Firm*—Breiner & Breiner, L.L.C.

(57) ABSTRACT

In a screen/film system offering a suitable method for radiological image formation the film material comprises a {111} tabular silver chlor(oiod)ide emulsion comprising a binder and silver chlor(oiod)ide crystals having at least 90 mole % of silver chloride, accounting for at least 50% of the total projective surface of said crystals, further having an average thickness of less than 0.3 $\mu$m, an average crystal diameter of more than 0.5 $\mu$m and an average aspect ratio more of than 2:1, wherein said tabular crystals have been spectrally sensitized with blue and/or green spectral sensitizers, characterized in that said crystals have been doped with at least one of a hexa-coordinated metal complex ion having at least 4 fluorine atoms according to the formula (I) as explained more in detail in the description and in the claims $$[ML_{6-n}F_n]^{m-} \quad \text{(I).}$$

8 Claims, No Drawings

EMULSION, MATERIAL AND SCREEN/FILM SYSTEM FOR RADIOLOGICAL IMAGE FORMATION

This application claims the benefit of Provisional Application 60/127,148 filed Mar. 31, 1999.

FIELD OF THE INVENTION

The present invention is related with a light-sensitive emulsion having doped {111} tabular grains, a material coated with such emulsions useful in a screen/film system for radiological image formation.

BACKGROUND OF THE INVENTION

In order to get high speed it is well-known that use of microcrystals rich in silver bromide is feasible. The intrinsic properties of AgCl/AgCl(I) emulsions are different from AgBr/AgBr(I) emulsions. As a consequence it is impossible to reach equal photochemical efficiencies for both systems without interfering in the intrinsic properties of the microcrystals rich in silver chloride. Comparing AgBr with AgCl from a point of view of differences between the energetic position of the highest valence level leads to striking conclusions. Especially for emulsions rich in silver chloride if used in combination with a green, a red or even with another dye absorbing at a higher wavelength, the quantum efficiency of the system may be limited because of the stability of the dye holes on the AgX surface, leading to recombination between photo-electrons and dye positive holes. This problem leads to "desensitization" and is known to be a factor limiting sensitivity, especially for high dye coverages. Enhancing the dye coverage of the emulsion crystals is nevertheless required in order to maximize absorption of light coming from light-emitting phosphors coated in the luminescent phosphor layers of intensifying screens. The advantage of making use therefore of {111} tabular crystals is related with the ratio of the surface to volume ratio of said crystals which is much higher than for globular crystals having an equivalent volume per crystal. It can thus also be expected that the dye desensitization will be more important for AgCl(I) {111} tabular crystals than for globular ones.

A classical way of preventing photocharges (photo-electrons and photo-holes) to recombine via a dye positive hole consists in introducing a reducing agent, sometimes called a supersensitizer.

However, this has been found to lead to severe shortcomings for the resulting materials. The adsorption of such a supersensitizer on the silver halide surface is contradictory to the idea of maximizing the adsorption of the spectral sensitizer and may dramatically limit the maximum dye coverage that can be attained. These organic dye molecules that should be added in a range of mmoles/mole of Ag may accumulate in the processing liquids thereby probably disturbing the optimum activity of these processings liquids or enhancing dye stain present after processing. Furthermore, introducing a reducing agent in an emulsion rich in silver chloride is rather critical for fog. In the concentration wherein a supersensitizer offers supersensitizing activity for green sensitizing dyes, fog can be formed either directly, either after a longer period, introducing stability problems. It is clear that there is a stringent demand for new measures in order to prevent the disadvantageous influences mentioned hereinbefore. Because of the high surface to volume ratio of {111} tabular silver chlor(oiod)ide microcrystals and as the stability of the morphology of the said microcrystals largely depends on the adsorption of grain growth stabilizers (such as the preferred "adenine"), whether or not in combination with spectral sensitizers, it will be very difficult to chemically sensitize these emulsions in order to get a limited number of efficient photo-electron trapping chemical sensitization centers per crystal. Concentration of the latent image in order to get less disperse latent image formation and a resulting increase in efficiency of silver utilization can be achieved by introducing specific dopants in the {111} tabular AgCl(I) crystals. This "latent image concentration effect" is known to depend on the specific position (site) of these dopants in the crystal with respect to the crystal surface and on the local concentration of these dopants in the doped phases or sites of the silver chor(oiod)ide microcrystals.

Adsorption of a large amount of organic compounds to the {111} tabular AgCl(I) crystal or grain surfaces will further strongly affect the developability of the material. The photochemical efficiency of the resulting material will therefore largely depend on the processing conditions, such as temperature, processing time, degree of oxidation/exhaustion of the processing solutions, etc . . .

In JP-A 03252649 and the corresponding USH 1294 and in JP-A 05134340, a detailed description of a material having tabular agcl(Br) emulsion crystals is given, for which a high sensitivity is claimed thanks to the introduction of dopants.

In U.S. Pat. No. 5,480,771 and similar patents as e.g. U.S. Pat. No. 5,500,335 the use of "SET" (Shallow Electron Trap)-dopants in combination with other kinds of dopants, thereby introducing deeper and more permanent traps for photo-electrons, are claimed. However the resulting materials have limited sensitivity and have very high contrasts because of the introduction of the other dopants. Therefore use of other "SET"'s like e.g. $M(CN)_{6-n}L_n$ or combinations of dopants with such sets is not suitable for radiological applications.

Similar effects on the developability can also be achieved by doping silver chlor(oiod)ide microcrystals with other kinds of dopants when added in minor amounts. E.g. when using a $IrCl_6^{3,4-}$ compound, a non-permanent trap for photo-electrons is obtained in AgCl or AgCl(I) microcrystals wherein a characteristic trap time for the photo-electron in the center is observed in that it is much longer than in the so-called "Shallow Electron Traps" (SET's), as a result of the doping with proposed hexacyano metal ligand compound (see e.g. R. S. Eachus, M. T. Olm, Cryst. Latt. Def. and Amorph. Mat., 18, 297–313, (1989)).

It is known that at high concentration of dopants desensitization of the doped emulsion with respect to emulsions without dopant often occurs (see e.g. S. H. Ehrlich, I. H. Leubner, J. Imag. Sci. 36(2), 105, (1992).). Otherwise use of too small amounts of dopants has disadvantages, such as stability of the compounds in dilute solutions, effects of heterogeneous incorporation of the compounds over the crystal population, reproducibility, etc.

Moreover, the resulting traps are known to trap the photo-electrons as long as seconds or even longer, depending on the local halide composition of the crystal phase in which they are incorporated, on the presence of charge compensating vacancies and on the degree of aquation (see e.g. R. S. Eachus, M. T. Olm, J. Soc. Photogr. Sci. Technol. Japan, 54(3), 294, (1991)). As a result of the slow release of the trapped photo-electrons, the sensitivity of the materials will largely depend on the time between exposure and development. In the first minutes up to one hour after exposure a sensitivity increase may be observed (ref. H. Zwicky, J. Photogr. Sci. 33, 201, (1985)). Therefore in order to achieve a high sensitivity and a good developability without latent image instabilities in the first minutes after exposure SET's are incorporated as dopants and every improvement related therewith is highly requested.

OBJECTS OF THE INVENTION

Therefore it is an object of the present invention to provide light-sensitive {111} tabular silver chlor(oiod)ide emulsions showing high overall sensitivity and good developability, if doped with small amounts of dopants in the range of at most $10^{-4}$ mole per mole of Ag.

It is a further object of the present invention to produce light-sensitive film materials having spectrally sensitized {111} tabular AgCl(I) emulsions of the present invention providing high sensitivity and good developability in radiographic screen/film application systems making use of luminescent intensifying screens.

It is a still a further object of the present invention to provide a film/screen system offering high speed, without impairing diagnostic value of the image obtained.

SUMMARY OF THE INVENTION

The above mentioned objects are realized by providing in a screen/film system offering a suitable method for radiological image formation a film material comprising at least one light-sensitive {111} tabular silver chlor(oiod)ide emulsion, said emulsion comprising a binder and silver chlor(oiod)ide grains or crystals having at least 90 mole % of silver chloride, accounting for at least 50% of a total projective surface of said crystals, having an average thickness of less than 0.3 μm, an average crystal diameter of more than 0.5 μm and an average aspect ratio of more than 2:1, wherein said tabular crystals have been spectrally sensitized with blue and/or green spectral sensitizers, characterized in that said crystals have been doped with a hexa-coordinated m-valent metal complex ion according to the formula (I)

$$[ML_{6-n}F_n]_{m-} \quad (I)$$

wherein n is an integer having a value of at least 4, wherein m is an integer having a value of 1, 2, 3 or 4, wherein M represents a metal selected from the group consisting of Ir, Os and Pt, and wherein L represents a ligand selected from the group consisting of Cl, Br and I.

Specific features for preferred embodiments of the invention are disclosed in the detailed description and in the dependent claims and further advantages and embodiments of the present invention will become apparent from the following description.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications and equivalents as may be included within the spirit and scope of the invention as defined by the appending claims.

As is known since quite a long time in the art photosensitive silver halide emulsions can be prepared by precipitation in an aqueous dispersing medium including, at least during grain growth, a peptizer in which silver ions and halide ions are brought together. Grain structure and properties are selected by control of several parameters like precipitation temperature, pH and relative proportion of the silver and halide ions in the dispersing medium. In order to avoid fog during the precipitation the grain preparation is commonly carried out on the halide side of the equivalence point which is defined as "the point at which the silver and halide ion activity is equal".

Moreover the silver halide emulsions of the present invention are prepared in the presence of compounds (generally known as dopants) which can be occluded in the crystal structure. Such a dopant is replacing an appropriate amount of silver and halide ions in the silver-halide lattice. The detection of the presence of said dopants in silver halide crystals themselves can be carried out by EPR or ENDOR techniques. The EPR technique and sample preparation has been described in U.S. Pat. No. 5,457,021 by Olm et al and by H. Vercammen, T. Ceulemans, D. Schoenmakers, P. Moens and D. Vandenbroucke in Proc. ICS&T of 49$^{th}$ Ann. Conf., p.54 (Minneapolis, May, 19–24 1996). The description of the ENDOR technique is given in the same Proc.Ann.Conf., p.56 by P. Moens, H. Vercammen, D. Vandenbroucke, F. Callens and D. Schoenmakers. These so-called dopants are modifying the crystal structure and are further influencing the properties of the crystal. Several parameters like sensitivity, gradation, pressure sensitivity, high or low intensity reciprocity failure (HIRF or LIRF), stability, dye desensitization, and several other sensitometric aspects of a photosensitive silver-halide emulsion can be modified by selection of the dopant, including its concentration, its valency and its location in the crystal in case of incorporation of the single metal ion. When coordination complexes or even oligomeric coordination complexes are used the different ligands bound at the central metal ion can be occluded in the crystal lattice too and can in this way influence the photographic properties of the silver halide material as well (see Research Disclosure No. 38957 (1996) p. 591, sect. I-D).

The present invention is based on the experimental data obtained with respect to the photographic effect of hexa-coordinated metal-halogen complexes which are incorporated into radiation sensitive silver halide grains which can be strongly enhanced if at least four of the halogen ligands are fluorine atoms. Such complexes are represented by formula (I):

$$[ML_{6-n}F_n]^{m-} \quad (I)$$

wherein:

M represents a metal selected from the group consisting of the elements belonging to Group 7, 8, 9 and 10 as well as to the Periods 4, 5 and 6 of the Periodic System of Elements (all references to groups and periods within the Periodic System of Elements are based on the format of the periodic table adopted by the American Chemical Society and published in 'Chemical and Engineering News', Apr. 2, 1985), p.26). In accordance with the present invention the elements belonging to the Periods 5 and 6 of the aforementioned group are preferred. Most preferred in the present invention however are the metals Ir, Os and Pt. These metals are often described together with many different ligands but complexes of these metals which correspond to formula (I) have never been encountered before as dopants in silver halide.

L therein represents one halogen atom or a mixture of differing halogen atoms selected from the group consisting of Cl, Br and I and, as a consequence, m is an integer having a value of 1, 2, 3 or 4, thereby indicating the electrical charges of the complexes corresponding to the formula (I).

Metal complexes containing metals as described hereinbefore together with only one halogen ligand are also described in literature as silver halide dopants but always in combination with another ligand determining the main activity of the dopant. Examples have been given in EP-A 0 336 426 (with CN-ligands), EP-A 0 336 427 (with NO- or NS-ligand), EP-A 0 415 480 (with oxo-coordination ligands), EP-A 0 415 481 (with CO-ligand), etc.

F represents the chemical element fluorine. In several patents fluorine-containing metal complexes are always described with another composition of ligands than the one represented by formula (I). The patents U.S. Pat. No. 5,474,888 and U.S. Pat. No. 5,500,335 describe fluorine-ligands situated in the complex together with NO, CN or NS as ligand causing the determining dopant results.

It is further important in formula (I) that n equals an integer having a value satisfying following equation: $4 \leqq n \leqq 6$, while m equals a value of 1, 2, 3 or 4.

In the screen/film system according to the present invention wherein a suitable method for radiological image formation is offered the film material thus comprises in one or more light-sensitive layers coated at one or both sides of the film support, an emulsion comprising a binder and {111} tabular silver chlor(oiod)ide crystals having at least 90 mole % of silver chloride, accounting for at least 50% of the total projective surface of said crystals, further having an average thickness of less than 0.3 $\mu$m, an average crystal diameter of more than 0.5 $\mu$m and an average aspect ratio of more than 2:1, wherein said tabular crystals have been spectrally sensitized with blue and/or green spectral sensitizers, characterized in that said crystals have been doped with at least one of a hexa-coordinated metal complex ion according to the formula (I)

$$[ML_{6-n}F_n]^{m-} \quad (I)$$

wherein n is an integer having a value of at least 4, wherein m is an integer having a value of 1, 2, 3 or 4, wherein M represents a metal selected from the group consisting of Ir, Os and Pt, and wherein L represents a ligand selected from the group consisting of Cl, Br and I.

In a preferred embodiment said emulsion described above comprises, in said tabular crystals, at least one hexafluoro-coordinated metal ion complex (wherein n=6 in formula (I)).

A survey of chemical structures that can be used as MHF-complex dopant in the present invention are summarized in Tables 1 to 3.

TABLE 1

| Ir(IV)-complexes |
|---|
| cis-$[IrF_4.Cl_2]^{2-}$ |
| trans-$[IrF_4.Cl_2]^{2-}$ |
| $[IrF_5.Cl]^{2-}$ |
| $[IrF_6]^{2-}$ |

The synthesis of all these complexes has been described in the following literature: D. Tensfeldt, W. Preetz, Z. Naturforsch 39b, 1185–1192, (1984): "Preparation and vibrational spectra of Fluoro-Chloro-Iridates(IV) including stereoisomers"; W. Preetz, Y. Petros, Angew. Chem. 83, 1019, (1971): "Vereinfachte Darstellung der Hexafluorokomplexe von Osmiun(IV), Iridium(IV) und Platin (IV)."

TABLE 2

| Os (IV)-complexes |
|---|
| cis-$[OsF_4.Cl_2]^{2-}$ |
| trans-$[OsF_4.Cl_2]^{2-}$ |
| $[OsF_5.Cl]^{2-}$ |
| $[OsF_6]^{2-}$ |

The synthesis of all these complexes has been described in the following literature: W. Preetz, D. Ruf, D. Tensfeldt, Z. Naturforsch. 39b, 1100–1109, (1984): "Preparation and vibrational spectra of Fluoro-Chloro-Osmates(IV) including stereoisomers"; W. Preetz, Y. Petros, Angew. Chem. 83, 1019, (1971): "Vereinfachte Darstellung der Hexafluorokomplexe von Osmiun(IV), Iridium(IV) und Platin(IV)".

TABLE 3

| Pt (IV)-complexes |
|---|
| cis-$[PtF_4.Cl_2]^{2-}$ |
| trans-$[PtF_4.Cl_2]^{2-}$ |
| $[PtF_5.Cl]^{2-}$ |
| $[PtF_6]^{2-}$ |

The synthesis of these complexes has been described in the following literature: W. Preetz, P. Erlhofer, Z. Naturforsch. 44b, 412–418, (1989): "Preparation and vibrational spectra of Fluoro-Chloro-Platinates (IV) including stereoisomers"; W. Preetz, Y. Petros, Angew. Chem. 83, 1019, (1971): "Vereinfachte Darstellung der Hexafluorokomplexe von Osmium(IV), Iridium(IV) und Platin(IV)".

The doping procedure itself can be performed normally at any stage in the grain growth phase of the emulsion preparation during which the reactants for silver halide formation are added to the reaction vessel in the form of solutions of silver and halide salts. This can be carried out by using two different jet-inlets for the individual reactant solutions.

The doping can also be executed during the grain growth process wherein the addition of the silver halide components are introduced as preformed silver halide nuclei or fine grains which easily dissolve in the precipitation medium.

In the present invention special attention should be paid to the way in which the dopants are introduced during the grain growth process. The addition of the dopants can be carried out in different ways: directly, incorporated into one of the reactant flows for the silver halide formation or as an individual injection next to the reactants, and indirectly by addition of a dispersion of fine soluble silver halide grains or nuclei already comprising the dopant. In the present invention the solution containing the dopant(s) satisfying formula (I) is preferably introduced by making use of a third jet in addition to said two jets for the introduction of the silver salt and the halide salt solution for the formation of the silver halide grains. This third jet is introduced in a zone of the reactor where the compounds are rapidly incorporated into the growing microcrystals. The advantage of using a third jet is that a solvent which is most suitable for the stability of that compound can be used for the given dopant. Furthermore the temperature of the dopant solution can be adjusted in order to maximize the stability. The most stable conditions for the dopant solution are preferably tested by UV-VIS absorption. The third jet itself can be adjusted automatically or manually. The dopant solution can be added at a constant rate or at any rate profile as has been described e.g. in JP-A 03163438, wherein the dopant is occluded in two different concentrations in the silver halide grains of a direct positive emulsion. The addition itself can be performed through surface or subsurface delivery tubes by hydrostatic pressure or by an automatic delivery system for maintaining control of pH and/or pAg in the reaction vessel and of the rate of the reactant solutions introduced therein, which method is used in a controlled double-jet precipitation procedure. Thereby the reactant solutions or dispersions can be added at a constant rate or a constantly increasing or fluctuating rate in combination with stepwise delivery procedures as desired.

More details about possible ways of making a silver halide emulsion that can be principally used in practising this invention are summarized in Research Disclosure No. 38957 (1996), p. 591–639, section I-C.

Besides dopants according to the present invention, to emulsions containing tabular silver halide grains having a core and an outermost shell, an organic hole trapping dopant satisfying formula (II) or (III) may be added:

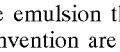

R—COOM' (II)

or formula (III):

(III)

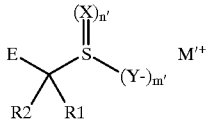

wherein

X and Y each independently represent O, S or Se;

R1 and R2 each independently represents and R represents hydrogen, a substituted or unsubstituted alkyl, a substituted or unsubstituted aryl, a substituted or unsubstituted aralkyl a substituted or unsubstituted heteroaryl;

wherein R1 and R2 can be the same or different and may form a ring; E represents a group linked to the carbon atom by a heteroatom, having at least one free electron pair;

M' is hydrogen, a metal or an organic group which can form a salt;

$M'^{+}$ is a proton or an inorganic or organic counterion;

m' and n' each represents an integer wherein m' equals 1 and n' equals 1 or 2.

The compounds of formula(e) (II) or (III) are preferably introduced in form of an aqueous solution to the silver halide emulsion which is already formed but less soluble compounds can be incorporated by using a water soluble hydrophilic organic solvent.

If the solutions of these compounds are not added together with either the silver salt solution or (less preferable) the halide salt solution, a separate introduction under or above the surface of the precipitating emulsion can be carried out by using one or more injection means. The position can be freely chosen and can be optimized. The addition can be carried out under hydrostatic pressure as driving force or by an motor-driven injection system which, if desired, can be automatic and computer controlled.

Attention should be however be paid to the position of a fourth inlet, if used, for the optional addition of the hole-trapping agent. The inlet should then preferably be mounted in such a way that the hole-trapping agent becomes supplied underneath the surface of the solution where the silver halide is precipitated. To express it in another way: the said fourth inlet should be positioned closer to the silver salt inlet than to the halide inlet. The injection of the optionally added hole-trapping agent as close as possible to the silver salt inlet is preferred while the combined and simultaneous addition of the hole-trapping agent and the silver salt solutions through one inlet is one of the ultimate and most preferred configurations in order to get effective hole trapping. This can be extrapolated to all the precipitation systems wherein solutions of organic dopant complexes and silver salt are mixed together before the formation of the silver halide emulsion crystal, doped with an organic hole trapping agent. When very low concentrations of the said organic hole trapping agents already lead to the desired sensitometric effects, it is even possible to prepare a solution by mixing an aqueous silver nitrate solution and a solution of an organic hole trapping agent.

The amount of dopant according to the formula (I) which is advantageously used in the present invention is limited and situated between $10^{-10}$ and $10^{-4}$ mole per mole of silver halide but preferably between $10^{-8}$ and $10^{-4}$ mole per mole of silver halide.

In a preferred embodiment of the present invention in the emulsion comprising tabular crystals as set forth in the statement of the present invention at least one of said metal ion complexes according to the formula (I) is thus present in an amount of up to $10^{-4}$ mole per mole of silver.

The concentration of dopant solution to be added is determined by various factors like the solubility of the complex, the stability of the desired solution, etc. The position in the silver halide crystals where the dopant is incorporated is also free to choose but depends on the trapping activity of the complex in the crystal. For several applications it can be interesting to have the dopant in a part of the grains of the emulsion and leave the other part without dopant.

In a preferred embodiment of the present invention in the emulsion comprising {111} tabular crystals at least one of said metal ion complexes is present in an annular ring. Moreover according to the present invention, said annular ring is present within 95 mole % of a total amount of formed or precipitated silver halide. Further according to the present invention in said annular ring said metal ion complex(es) is(are) present in an amount of from $1\times10^{-6}$ up to $1000\times10^{-6}$ mole per mole of silver.

The photographic emulsions prepared in this way for use in the image-forming element or material of the present invention contain silver halide crystals comprising combinations of silver chloride and silver iodide. Other silver salts which can be incorporated into a limited amount in the silver halide lattice are silver phosphate, silver thiocyanate and some other silver salts including organic silver salts like silver citrate and others. The chloride and iodide salts can be combined in all ratios in order to form a silver chloroiodide salt. Iodide ions however can be coprecipitated with chloride in order to form a chloroiodide with a iodide amount depending on the saturation limit of iodide in the lattice with the given halide composition; i.e. up to a maximum amount 13 mole % in silver iodochloride both based on silver.

According to the present invention in the film/screen system according to the present invention said emulsion comprising silver chlor(oiod)ide crystals have at least 95 mole % of silver chloride and, in an even more preferred embodiment, at least 99 mole % of silver chloride.

In tabular crystals of the emulsions of the present invention silver chlor(oiod)ide tabular crystals account for at least 50%, more preferably at least 70% and even more preferably at least 90% of THE total projective surface of said crystals, wherein the said crystals or grains have an average thickness of less than 0.3 μm, more preferably from 0.06 up 0.25 μm and still more preferably from 0.08 up to 0.20 μm, an average crystal diameter of more than 0.5 μm (up to at most 10 μm and more preferably up to 5 μm) and an average aspect ratio (ratio of equivalent circular diameter to thickness) of more than 2:1, more preferably of from 5:1 up to 50:1 and still more preferably of from 8:1 up to 25:1.

The silver halide emulsions having tabular silver chloroiodide grains can be either monodisperse (variation coefficient of up to 0.20, more preferably from 0.10 up to at most 0.20) or polydisperse (more than 0.20) after precipitation. The polydispersity can be the result of mixing two or more monodispersed emulsions.

Besides the dopants represented by formula (I) and, optionally (II) and/or (III), other dopants can be added during the preparation of the silver halide emulsion. These are optionally introduced only if their specific influence on the photographic characteristics is desired.

It is also possible that e.g. $RuCl_5(NO)^{3-}$ (as deep electron trap) is used together with $PtF_6^{2-}$ as SET. At any time the specific activity of the dopants of the present invention can be clearly demonstrated by using the EPR or ENDOR techniques which have been extensively described in the aforementioned references of Vercammen et al and Moens et al. Many examples have already been described in the patent literature but cover different silver halide systems like those mentioned hereinbefore in WO 92/16876, EP-A 0 264 288 and in EP-A 0 552 650.

The {111} tabular silver halide emulsion grains or crystals as mentioned hereinbefore can be prepared in various ways by conventional methods. As already shortly summarized these methods always start with a nucleation phase in controlled conditions of pAg and pH followed by one or more grain growth steps, after one or more physical ripening steps. In the emulsion preparation reactants are added to the reaction vessel in form of solutions of silver salts and halide salts or in the form of preformed silver halide nuclei or fine grains which easily dissolve in the precipitation medium. The individual silver and halide salt solutions can be added through surface or subsurface delivery tubes by hydrostatic pressure or by an automatic delivery system for maintaining the control of pAg and/or pH in the reaction vessel and of the rate of the reactant solutions introduced in it. The adjustment of the pAg and pH value is very important in connection with the use of compounds which satisfy formula(e) (I), (II) and/or (III) for emulsions of the present invention while it determines the activity of these dopants. The pH is therefore preferably situated between 1 and 10 but most preferably between 2 and 8. The pAg at the other side is preferably situated between 2 and 9 and most preferably between 3 and 8.

As taught for the compounds used for incorporation in the tabular silver halide emulsions according to the present invention the reactant solutions or dispersions for the preparation of the silver halide itself can be added at a constant rate or at a constantly increasing, decreasing or fluctuating rate, if desired in combination with stepwise delivery procedures.

An indirect way of preparing emulsions according to the present invention makes use therefore of fine silver halide grains having a well-defined silver halide composition which are dissolved in the presence of the so-called host grains thereby forming a 'shell' or 'band' on the given 'basic' or 'core' grain. This mechanism proceeds as a consequence of Ostwald ripening, being a physical ripening mechanism driven by differences in grain size and solubility thereof. Addition of iodide, normally performed by addition of an inorganic iodide salt or, if slower liberation of iodide in the reaction is desired, by addition of organic iodide releasing agents, leads to an increased iodide content by conversion, wherein iodide ions are replacing halides of much more soluble silver halide salts as silver chloride. Addition of iodide to emulsion grains rich in silver chloride is however also possible by adding fine preformed grains of silver iodide, whether or not including bromide and/or chloride in minor amounts, said grains having a grain diameter of not more than 100 nm, and, more preferably, not more than 50 nm. Such fine grains are so-called "Lippmann" emulsions.

Addition of iodide by organic agents releasing iodide ions, which is an embodiment which can advantageously be applied within the context of the preparation of emulsions according to the present invention, is in favour of the realization of homogeneous distribution of iodide into the crystal volume of {111} tabular grains or crystals containing silver iodide as has been demonstrated e.g. in EP-A's 0 561 415, 0 563 701, 0 563 708 and 0 651 284 and in U.S. Pat. Nos. 5,482,826 and 5,736,312. In this context {111} tabular grains rich in silver chloride can be prepared as has been described in EP-A 0 678 772, wherein an emulsion has been claimed comprising silver chlorobromoiodide or silver chloroiodide tabular grains having {111} crystal faces, having at least 75 mole % of chloride and from 0.1 up to less than 1 mole % of iodide, based on silver, having an average aspect ratio of at least 8:1, an average grain thickness of from 0.08 μm to less than 0.2 μm, wherein at least 50% of the total projected area is provided by said tabular grains, wherein said grains have a variable iodide profile, built-up by introduction of an organic compound releasing iodide ions. In an alternative method iodide ions can be released from iodate as has been described in U.S. Pat. No. 5,736,312.

Addition of iodide as fine silver iodide grains, which is an embodiment which may advantageously be applied within the context of the present invention, can be performed as has been described for the preparation of {111} tabular grains in JP-A's 04251241 and 08029904 and in EP-A's 0 662 632 and 0 658 805, wherein an outermost phase rich in silver iodide has been added to {111} tabular grains rich in silver bromide. More particularly ultrafine AgI-grains can be introduced as seed emulsions as has been described in EP-A 0 621 505 or can be used in order to prepare core-shell emulsions as described in EP-A 0 517 434, wherein two phases in the crystal differing in composition have thus been built up. Release of iodide in the presence of a compound adjusting the rate of iodide release can be applied as described in U.S. Pat. No. 5,807,663 in order to get a multilayered structure in the silver halide tabular emulsion grains.

Further according to the present invention emulsions having {111} tabular crystals rich in silver chloride may be prepared, as described in the patent literature, apart from addition of organic hole trapping agents according to the formula(e) (II) and/or (III). So apart from emulsions as described in EP-A 0 678 772, already mentioned above, emulsions disclosed in Research Disclosure 388046, published Aug. 1, 1996, can be used. In that Research Disclosure {111} tabular grain emulsions treated with iodide for enhanced morphological stability and enhanced photographic performance have been described. Moreover {111} tabular silver chlor(oiod)ide emulsions may be prepared as has been described in EP-A 0 866 362, wherein an improved homogeneity has been obtained. It is well-known that in order to prepare {111} tabular silver halide crystals rich in silver chloride habit modifying agents are required in order to stabilize the said habit. Preferred crystal habit modifiers therefore are azine or xanthinoid compounds as disclosed in EP-A 0 577 173, amino azine compounds as in EP-A 0 584 811, iodo-substituted 8-hydroxyquinoline as in EP-A 0 694 810, iodo substituted phenols as in EP-A 0 694 809, pyridinium salts as in U.S. Pat. No. 5,691,128, etc., without however being limited thereto. Adenine is one of the most preferred as described in EP-A 0 481 133. Apart from the normally used gelatin as a binder or protective colloid during precipitation and emulsion preparation before coating use can be made of alternatives as natural or synthetic polymers or (block) co-polymers or colloidal silica. So in U.S. Pat. Nos. 5,498,518; 5,593,820 and 5,607,828, oxidized cationic starch has e.g. been described as a peptizer; in EP-A's 0 724 190, 0 762 192 a polyalkylene block copolymer has e.g. been used and in EP-A 's 0 770 909 and 0 767 400 colloidal silica has been used as a protective colloid.

After precipitation the emulsions can be coagulated and washed in order to remove any excess of aqueous soluble salts. These procedures are, together with different alternative methods like dia- or ultrafiltration and ion-exchange techniques, described in Research Disclosure No. 38957 (1996), section III.

The silver halide emulsions can be chemically sensitized in many different ways. It can be carried out in the presence of a chalcogen as sulphur, selenium or tellurium, in the presence of a noble metal as e.g. gold or in combination with one or more compounds providing a chalcogen and noble metal. Sometimes it can be necessary to add a sulphur sensitizer in the form of a dispersion of solid particles as described in EP-A 0 752 614. Reduction sensitization is another method of sensitizing a photosensitive silver halide emulsion that can be combined with the chalcogen/noble metal sensitization if desired. Reduction sensitization should be mentioned as a way of introducing hole traps into the silver halide crystals for use in the image-forming elements according to the present invention in order to optimize the efficiency of latent image formation. It is clear that the incorporation of hole traps into silver halide can also be realized in other ways e.g. by the introduction of $Cu^{(+)}$, $Ni^{(2+)}$, etc. Reduction sensitization can be performed by decreasing the pAg of the emulsion or by adding thereto reducing agents as e.g. tin compounds (see GB-Patent 789,823), amines, hydrazine derivatives, formamidine-sulphinic acids, silane compounds, ascorbic acid, reductic acid and the like. Care should however be taken in order to avoid generation of fog in an uncontrollable way. Certain "modifying agents" that can optimize the chemical sensitization process are often used. A complete description of quite a lot of different possibilities with respect to this subject can be found in Research Discl. No. 38957(1996), sect. IV, and in EP-A 0 862 088.

In a next step the silver halide emulsions used in the image-forming elements according to the present invention are spectrally sensitized with dyes from different classes which include polymethine dyes comprising cyanines, merocyanines, tri-, tetra- and polynuclear cyanines and merocyanines, oxonols, hemioxonols, styryls, merostyryls, etc. Sometimes more than one spectral sensitizer may be used in case wherein a larger part of the spectrum should be covered. Combinations of several spectral sensitizers are sometimes used to get supersensitization, meaning that in a certain region of the spectrum the sensitization is greater than that from any concentration of one of the dyes alone or that which would result from the additive effect of the dyes. Generally supersensitization can be attained by using selected combinations of spectral sensitizing dyes and other addenda such as stabilizers, development accelerators or inhibitors, brighteners, coating aids, etc. A good description of all the possibilities in spectral sensitization that is important with respect to this invention can be found in Research Disclosure No. 38957 (1996), section V.

Said spectral sensitization can be performed during or after chemical ripening. Said chemical ripening is not deemed to be performed after spectral sensitization but for the type of crystals of the emulsion used in the screen-film combination of the present invention requiring stabilizing site-directors as {111} tabular crystal habits, it is preferred to do so. Chemically sensitizing compounds can in practice be added as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas; selenium e.g. selenosulphate, selenocyanate, selenoureas; tellurium e.g. tellurosulphate, tellurocyanate, telluroureas; sulphites, mercapto compounds, rhodamines etc. The emulsions can be sensitized also by means of gold-sulphur ripeners, gold-selenium ripeners, gold-sulphur-selenium ripeners, or by means of reductors e.g. tin compounds as described in GB-A 789,823, amines, hydrazine derivatives, formamidine-sulphinic acids, and silane compounds although care should be taken in order to prevent the emulsion from fog formation in an uncontrollable way.

A suitable way to stabilize emulsions having been chemically ripened with sensitizers comprising selenium has been described in U.S. Pat. No. 5,654,134 wherein benzothiazolium compounds, mercapto containing agents and disulfides have been described in order to provide a good fog-sensitivity relationship. As specific examples of the unstable selenium sensitizers, there are isoselenocyanates (e.g., aliphatic isoselencyanates such as allylisoselenosyanate), selenoureas, selenoketones, selenoamides, selenocarboxylic acids (e.g. 2-selenopropionic acid, and 2-selenobutyric acid) seleno-esters, diacylselenides (e.g. bis(3-chloro-2,6-dimethoxybenzoyl)-selenide), selenophosphates, phosphineselenides, preferably triphenylphosphorselenide and colloidal elemental selenium. Preferred examples of unstable type selenium compounds shown above are however not limited thereto in any way. For the technical experts in the field of the art provided that unstable type selenium compounds are sensitizers for silver halide emulsions rich in silver chloride, the structure of the compounds is not so important if selenium is unstable and it is generally understood that the organic moiety of a selenium sensitizer molecule has no role except that it carries selenium and makes the selenium exist in a silver halide emulsion in an unstable form. A preferred selenium compound for the chemical ripening of silver halide emulsion crystals rich in chloride having silicic acid (colloidal silica) as a protective colloid is e.g. a phosphonium precursor compound having a structure corresponding to the general formula ($R^3$) ($R^4$) ($R^5$)-$P^+$=Se, wherein each of $R^3$ and $R^5$ (same or different) represents hydrogen, an alkyl group, a substituted alkyl group, a cycloalkyl group, an aryl group or a substituted aryl group, $R^4$ represents any of the said groups represented by $R^3$ and $R^5$ or the atoms necessary to close a heterocyclic nucleus with either $R^3$ or $R^5$, the said onium ion being linked 1) to a polymer chain, or 2) via a bivalent organic linking group e.g., O, S, $SO_2$, . . . to any other of such onium structure, or 3) directly to any of the groups represented by $R_1$. Suitable examples of the said phosphonium compounds are disclosed in U.S. Pat. No. 3,017,270.

A combination of chemically ripened and spectrally sensitized silver halide emulsion grains of the same or different types coated in one or in two adjacent layers at one and/or at both sides of the support of the film material is also enclosed in the present invention, provided that at least one, and preferably all of said emulsion grains are spectrally sensitized with specific UV/blue and/or green spectral sensitizers offering enough speed to the radiographic screen-film combination according to the present invention.

More particularly azacyanine dyes according to the formulae (IV.1)–(IV.11), disclosed in EP-A 0 890 873, represented hereinafter, and used as ultraviolet light absorbing spectrally sensitizing dyes are therein preferred.

(IV.1)

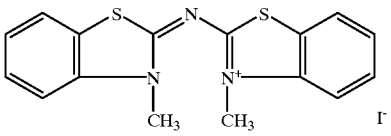

(IV.2)

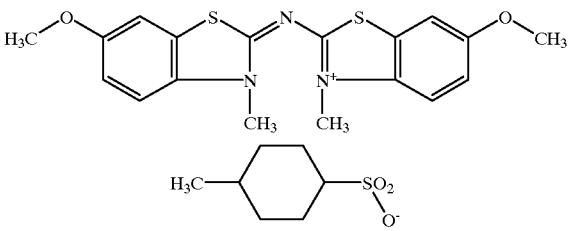

(IV.3)

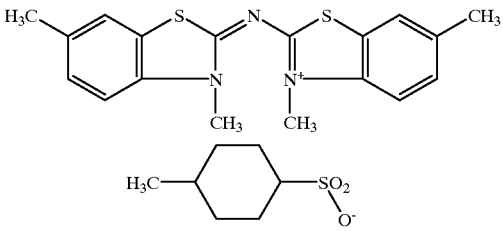

(IV.4)

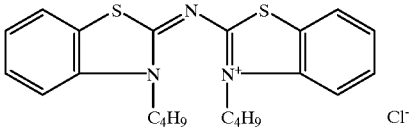

(IV.5)

-continued

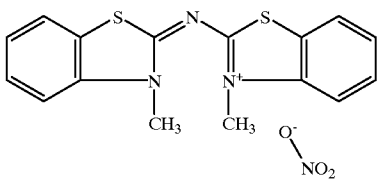

(IV.6)

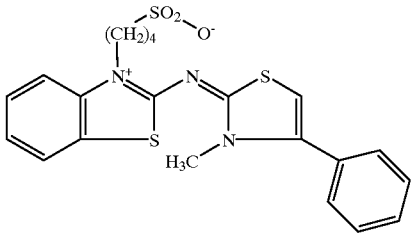

(IV.7)

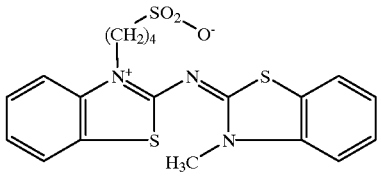

(IV.8)

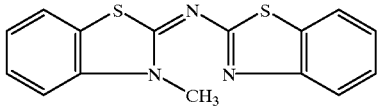

(IV.9)

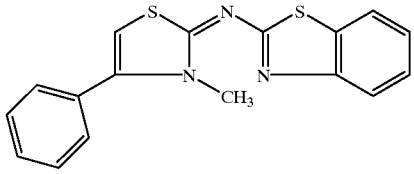

(IV.10)

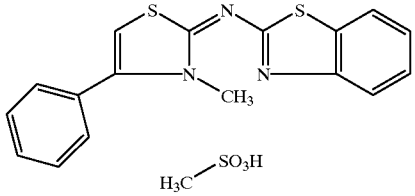

(IV.11)

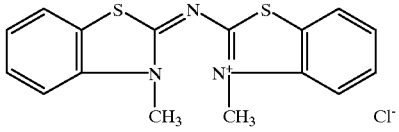

These formulae (IV) are represented by the general formula (IVA) and (IVB)

(IVA)

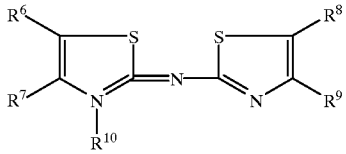

-continued (IVB)

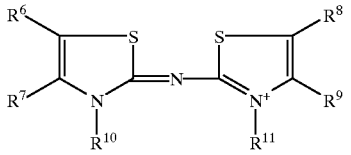

wherein each of the substituents $R^6$–$R^9$ independently represents hydrogen, an unsubstituted or substituted alkyl, an unsubstituted or substituted aryl or an unsubstituted or substituted aralkyl;

wherein $R^6$ and $R^7$ and/or $R^8$ and $R^9$ may form a substituted or unsubstituted benzoring, which, if substituted, has the same or different substituents as $R^6$–$R^9$;

wherein $R^{10}$ represents a substituted or unsubstituted alkyl, aryl or aralkyl group;

wherein $R^{11}$ represents hydrogen, a substituted or unsubstituted alkyl, aryl or aralkyl group;

and wherein cations and/or anions are present as charge compensating ions.

Further preferred blue spectral sensitizers are those described in EP-A 0 712 034. Representative therefore are those given in the general formula (V) given hereinafter.

(V)

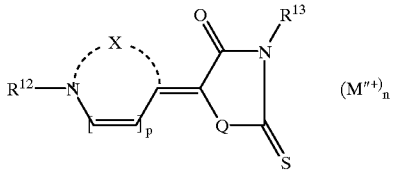

wherein

X represent the atoms, necessary to form a heterocyclic 5- or 6-membered ring (as is typical for cyanine dyes);

Q represents S, $NR^3$, O, or —(C═O)—N($R^4$)—;

$M''^+$ represents a kation, e.g., $Li^+$, $Na^+$, $K^+$, $HN^+(C_2H_5)_3$;

n equals 0, 1, or 2;

p equals 0 or 1;

$R^{12}$, $R^{13}$, $R^{14}$ and $R^{15}$ each independently represent a substituted or unsubstituted $C_1$–$C_5$ alkyl chain, with the proviso that at least one of $R^{13}$, $R^{14}$ and $R^{15}$ has a solubilizing group as, e.g., $(CH_2)_mSO_3^-$ or $(CH_2)_mN(R)SO_3^-$ wherein m equals 1, 2, 3 or 4, wherein R has the same meaning as $R^{12}$ to $R^{15}$;

$(CH_2)_2CH(Y)SO_3^-$ wherein Y represents $CH_3$—, —Cl or —OH;

$(CH_2)_qOSO_3^-$ wherein q equals 2 or 3;

$(CH_2)_rCO_2^-(H^+)$ wherein r equals 1, 2 or 3;

$(CH_2)_sSO_2^-(CH_2)_tH$ wherein s equals 2 or 3 and t equals 1 or 2;

$(CH_2)_x$-Phen-W, wherein W represents —$COO^-$ or $SO_3^-$; Phen represents phenyl which is substituted or unsubstituted; and x equals 1, 2, 3 or 4;

or a latent solubilizing group as, e.g., $(CH_2)_{m'}$, —(C═O)—O—$CH_2$—(C═O)—$CH_3$, wherein m' is an integer having a value of from 1 to 5.

Preferred blue sensitizing dyes according to the general formula (V) are (V.1)

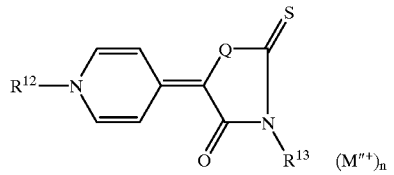

(V.2)

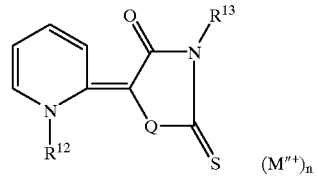

wherein all symbols have the same meaning as in formula (V) given hereinbefore.

Still more preferred structures of the blue sensitizing dyes are pyridyl rhodanines, given in formula (V.3).

(V.3)

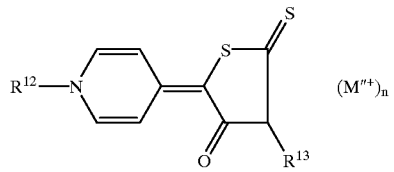

Spectral sensitizers absorbing green light in order to spectrally sensitize silver chlor(oiod)ide emulsions of the present invention are those given by the formulae (VI) and (VII), representing the preferred benzimazolocarbocyanine and benzoxazolocarbocyanine dyes respectively given in EP-A 0 930 527.

(VI)

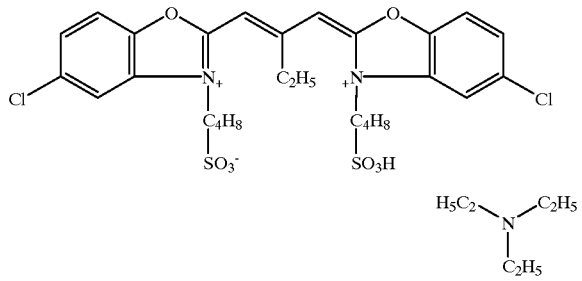

(VII.1)

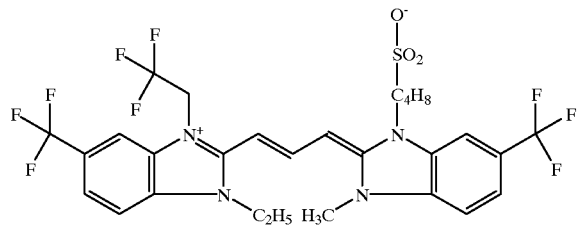

-continued (VII.2)

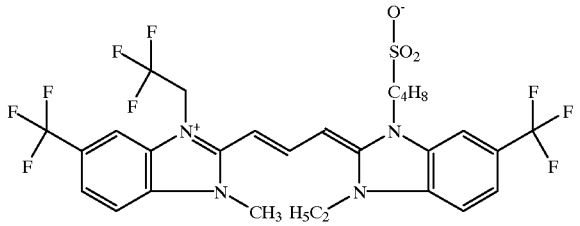

(VII.3)

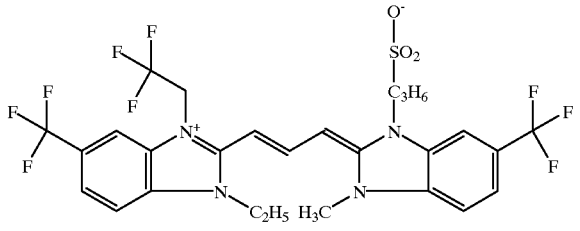

(VII.4)

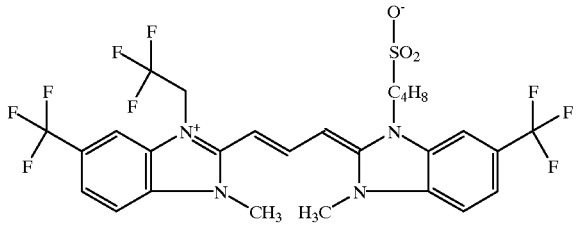

(VII.5)

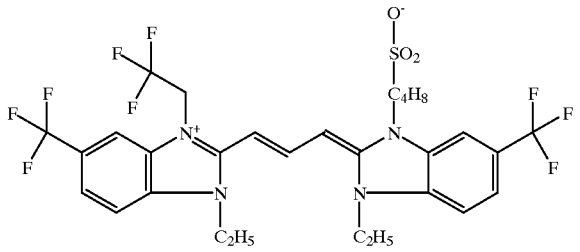

A conventional radiographic layer arrangement can be provided according e.g. to the one described in EP-A 890 873 or in EP-Application No. 98200061, filed Jan. 13, 1998. A suitable multilayer arrangement which can be applied has been described in EP-A 0 770 909. Therein a multilayer light-sensitive silver halide photographic negative image type material has been described comprising on at least one side of a support a multilayer composition of at least two layers of negative image type silver halide emulsions adjacent to each other, wherein the emulsion layer closest to the said support comprises tabular emulsion crystals selected from the group consisting of silver chloride, silver chlorobromide, silver chloroiodide, silver chlorobromoiodide, silver bromide and silver bromoiodide having a {111} crystal habit and silver chloride, silver chlorobromide, silver chloroiodide and silver chlorobromoiodide having a {100} crystal habit and wherein the adjacent layer(s) farther from the said support comprise(s) essentially cubic emulsion crystals selected from the group consisting of silver chloride, silver chlorobromide and silver bromide and wherein the halide composition of the said cubic emulsion crystals or of the said tabular emulsion crystals or both includes chloride. In the context of the present invention it is clear that only {111} tabular silver chloride and silver chloroiodide emulsion grains are then used in the light-sensitive emulsion layers having tabular grain emulsions, wherein said grains have been doped with the dopants according to the formula (I) as set forth hereinbefore.

In another embodiment as described in EP-A 0 752 617 the radiographic silver halide material has on at least one side of a support, covered with a hydrophobic subbing layer comprising as a latex copolymer vinylidene chloride, methylacrylate and itaconic acid, following hydrophilic layers: at least one gelatinous dye containing layer comprising one or more dyes, at least one silver halide emulsion layer, at least one protective antistress layer, and optionally an afterlayer, characterized in that said hydrophilic layers have a swelling ratio of not more than 200%. One or more merostyryl dye(s) can be present as antihalation dye(s) in the gelatinous dye containing layer situated between the subbing layer, being in direct contact with the support in order to provide good adhesion of coatings, and the light-sensitive emulsion layer more close to the said subbing layer, wherein preferred amounts of dyes are chosen in order to get a ratio by weight of dye to gelatinous hydrophilic binder between 0.4 and 1.3. Preferred merostyryl dyes characterized by a solubility at an alkaline pH of at least 8 (as e.g. in processing conditions) and insolubility at pH values less than 6.0, in order to get a good discoloration said merostyryl dye is present in form of a microprecipitated dispersion (preferably prepared according to the methods described in EP-A 0 724 191).

A preferred merostyryl dye for use as a so-called antihalation dye, contributing to the lowering of cross-over of the material according to the material in the screen/film combination according to the present invention are the merostyryl dyes having a pyrazolon nucleus the formulae of which are given hereinafter:

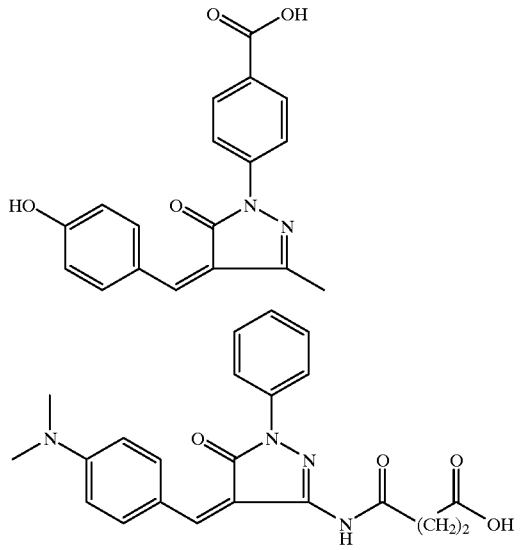

It is further preferred in the context of the present invention and in order to provide rapid processing ability that hydrophilic layers of the silver halide materials are hardened to such an extent as to have a swelling ratio of not more than 200% or to absorb not more than 1 g per gram of coated gelatin per square meter (when unprocessed, exposed materials are immersed for 3 minutes in demineralized water of 25° C. after having been conditioned said materials for 3 days in a room at a temperature of 57° C. and at a relative humidity RH of 34%).

The photographic elements comprising said silver halide emulsions may include various compounds which should play a role of interest in the material itself or afterwards as e.g. in processing, finishing or storing the photographic material.

These products can be stabilizers and anti-foggants (see RD No. 38957(1996), section VII), hardeners (RD No.38957(1996), section IIB), brighteners (RD No.38957 (1996), section VI), light absorbers and scattering materials (RD No.38957(1996), section VIII), coating aids (Res.Disclosure,No.38957(1996), section IXA), antistatic agents (Res.Disclosure,No.38957(1996) section IXC), matting agents (same Res.Disclosure,No. 38957(1996), section IXD) and development modifiers (same Res.Disclosure, section XVIII). The silver halide material can also contain different types of couplers that can be incorpated as described in the same Res.Disclosure, section X.

The photographic elements can be coated e.g. by the preferred slide-hopper or curtain coating techniques on a variety of supports as described in Res.Disclosure,No. 38957(1996), section XV, and the references cited therein. Recently developed supports as polyethylene naphthalate are thereby not excluded.

According to the present invention a material having coated on at least one side of a support at least one light-sensitive silver halide emulsion layer comprising an emulsion as disclosed hereinbefore is thus used in order to provide a screen/film system having in operative association with that material at one or both sides thereof, an intensifying screen comprising luminescent phosphors emitting UV/blue and/or green light.

X-ray intensifying screens used in the film/screen system according the present invention can be self-supporting or supported. X-ray intensifying screens. Generally these screens comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto.

Examples of support materials include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. A plastic film is preferably employed as the support material.

Depending on the speed class of the screens for which a synergistic effect should be attained in the relation between speed and sharpness, supports characterized by their reflectance properties, expressed as % reflectance over the wavelength range from 350 to 600 nm, are particularly used. Such supports can be highly light reflecting as e.g. polyethylene-terephthalate comprising a white pigment, e.g. $BaSO_4$, $TiO_2$, etc., or it can be light absorbing supports, e.g. polyethylene terephthalate comprising a black pigment, e.g. carbon black. Supports comprising dyes or pigments that absorb light of a specific wavelength can also be useful in the preparation of X-ray intensifying screens according to the present invention.

In most applications the phosphor layers contain sufficient binder to give structural coherence to the layer. In view of a possible phosphor recovery from worn-out screens the binder of the phosphor containing layer is preferably soluble and remains soluble after coating.

Useful binders, a non-limitative survey of which is given herein, include proteinaceous binders, e.g. gelatin, polysaccharides such as dextran, gum arabic, and synthetic polymers such as polyvinyl butyral, polyvinyl acetate, nitrocellulose, ethylcellulose, vinylidene chloride-vinyl chloride copolymer, polyalkyl (meth)acrylate, vinyl chloride-vinyl acetate copolymer, polyurethane, cellulose acetate, cellulose acetate butyrate, polyvinyl alcohol, polystyrene, polyester, etc. These and other useful binders are disclosed e.g. in U.S. Pat. Nos. 2,502,529; 2,887,379; 3,617,285; 3,300,310; 3,300,311 and 3,743,833.

A mixture of two or more of these binders may be used, e.g., a mixture of polyethyl acrylate and cellulose acetobutyrate.

The weight ratio of phosphor to binder is generally within the range of from 50:50 to 89:11, preferably from 80:20 to 89:11.

The screen according to the present invention may comprise a supported layer of phosphor particles dispersed in a binding medium comprising one or more rubbery and/or elastomeric polymers as described in EP-A's 0 647 258 and 0 648 254. In this way a ratio by weight of pigment to binding medium of more than 90:10 and more preferably of at least 93:7, e.g. 98:2 can be obtained providing besides an excellent image resolution a high ease of manipulation as a result of a good elasticity of the screen and good adhesion properties between the support and the phosphor layer. Problems concerning staining of screens comprising said rubbery binder(s) may be overcome by the addition of known rubber anti-oxidation compounds like IRGANOX 1010 and IRGASTAB T36 (trademarked products of CIBA-GEIGY, Basel, Switzerland), ANTIOXIDANT 330 (trademarked product of ETHYL CORP., Richmond, USA), VANOX 2246 (trademarked product of VANDERBILT ENERGY CORP., Denver, Canada) etc, this list being non-limitative. The binder used in screens according to the present invention, with high phosphor to binder ratio, can beneficially be a polymer P having a $T_g$ £ 0° C., an average molecular weight ($MG_{avg}$) between 5000 and $10^7$, being soluble in ethylacetate for at least 5% by weight (% wt/wt). A self-supporting layer of 82% by volume of phosphor particles in said polymer P, having a thickness so has to comprise 100 mg of phosphor particles per $cm^2$, has an elongation to break of at least 1%. Such polymers have been disclosed in EP-A 0 758 012 and the corresponding U.S. Pat. No. 5,663,005.

The phosphor layer can be applied to the support by employing a method such as vapour deposition, sputtering and spraying but is usually applied by the following procedure.

Phosphor particles and a binder are added to an appropriate solvent as described hereinafter, and are then mixed in order to prepare a coating dispersion comprising the phosphor particles homogeneously dispersed in the binder solution. Said coating dispersion may further comprise a dispersing agent and plasticizer and filler material as described hereinafter.

The coating dispersion containing the phosphor particles and the binder is applied uniformly onto the surface of the support to form a layer of the coating dispersion. The coating procedure may proceed according to any conventional method such as doctor blade coating, dip-coating or roll coating.

For the preparation of highly abrasion resistant and chemically resistant phosphor-binder layers the binder is cured. Curing of the binder may proceed photochemically by means of UV radiation or with electron beam (EB) as described e.g. in Research Disclosure December 1977, item 16435 or proceeds purely chemically as described e.g. in U.S. Pat. No. 4,508,636. It may also be cured by moisture as described in EP-A 0 541 146. Curing may also be performed by heating.

In the preparation of the phosphor screen having a primer layer between the substrate and the fluorescent layer, the primer layer is provided on the substrate beforehand, and then the phosphor dispersion is applied to the primer layer and dried to form the fluorescent layer.

After applying the coating dispersion onto the support, the coating dispersion is then heated slowly to dryness in order to complete the formation of a phosphor layer.

In order to remove as much as possible entrapped air in the phosphor coating composition it can be subjected to an ultrasonic treatment before coating. The phosphor-binder layer (as described e.g. in U.S. Pat. No. 4,059,768) can be calendered to improve the phosphor packing density in the dried layer.

Useful solvents for the binder of the phosphor containing layer, employable in the preparation of the phosphor coating dispersion include lower alcohols such as methanol, ethanol, n-propanol and n-butanol; chlorinated hydrocarbons such as methylene chloride and ethylene chloride; ketones such as acetone, butanone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether; methyl glycol; and mixtures of the above-mentioned solvents.

Useful dispersing agents for the phosphor particles in the coating dispersion to improve the dispersibility of the phosphor particles therein, may contain a variety of additives such as a plasticizer for increasing the bonding between the binder and the phosphor particles in the phosphor layer. Examples of the dispersing agent include ionic and nonionic well-known dispersing agents or combinations thereof, e.g., DISPERSE AYD (trade name of Daniel Products Company, New Jersey, USA) GAFAC RM 610 (a tradename a polyoxyethylene (20) sorbitan monopalmitate and monolaurate marketed by General Aniline and Film Company (GAF) New York, USA, polymeric surfactants such as the acrylic graft copolymer, PHOSPHOLIPON 90 (trade name) marketed by Nattermann-Phospholipid GmbH, Köln, W. Germany, silane dispersing agents and surfactants e.g. DOW CORNING 190 (trade name) and SILANE Z6040 (trade name) marketed by Dow Corning Corporation, Midland, Mich., USA or glymo-3-glycidyloxy-propylmethoxysilane or organosulfate polysilanes, unsaturated p-aminamide salts and high molecular acid esters such as ANTI TERRA U 80 (trade name) marketed by BYK-Chemie GmbH, Wesel, W. Germany, high molecular unsaturated polyesters, etc. Dispersing agents are added in an amount of 0.05 to 10% by weight based on the phosphor.

Useful plasticizers include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; polymeric plastizers, e.g. and polyesters of polyethylene glycols with aliphatic dicarboxylic acids such as polyester of triethylene glycol with adipic acid and polyester of diethylene glycol with succinic acid.

After the formation of the fluorescent layer, a protective layer is generally provided on top of the fluorescent layer. In a prefer-red embodiment the protective coating has a layer thickness d comprised between 1 and 50 $\mu$m and an embossed surface roughness is applied for high ease of manipulation, thereby avoiding sticking, friction and electrostatic attraction with maintenance of an excellent image resolution. The embossed protective layer can be provided on the phosphor layer in order to protect it against mechanical and chemical damage by the steps of (1) coating onto said phosphor containing layer a liquid radiation-curable composition having at the coating temperature a viscosity of at least 450 mPa.s, measured with a Hoeppler viscometer, that does not penetrate for a substantial degree into the phosphor containing layer, (2) providing an embossed structure to the coating, and (3) curing said coating by radiation.

More details concerning preferred protective coatings with embossed surface can be found in EP-A's 0 510 753 and 0 510 754.

Assemblies providing means for reducing cross-over to less than 10% for radiation longer than 300 nm in wavelength have been described e.g. in U.S. Pat. No. 5,259,016.

In practice the light emitted imagewise by said X-ray intensifying screen irradiates a contacting photographic silver halide emulsion layer film which after exposure is developed to form therein a silver image in conformity with the X-ray image. For use in common medical radiography (projection radiography) the X-ray film comprises a transparent film support, coated on both sides with a silver halide emulsion layer. During the X-ray irradiation said film is arranged in a cassette between two X-ray intensifying screens each of them making contact with its corresponding silver halide emulsion layer.

Phosphors suitable for use in the conventional radiographic system must have a high prompt emission of fluorescent light on X-ray irradiation and low afterglow in favour of image sharpness. The relationship between resolution and speed of X-ray intensifying screens is described e.g. in Med. Phys. 5(3), 205 (1978).

Specific intensifying screens emitting ultraviolet-blue (UV/blue) radiation have further been disclosed in U.S. Pat. Nos. 4,225,653; 4,387,141; 4,710,637; 5,112,700; 5,173,611 and 5,432,351; in EP-A's 0 650 089; 0 658 613; in PCT-Applications Wo 93/11457 and WO 95/15514. Typical blue-UV emitting phosphors therein are tantalates as described in PCT-Applications WO 93/1521 and 93/1522, hafnates as described in U.S. Pat. No. 5,173,611 and fluorohalides (fluorobromides) of barium and strontium as in WO 91/1357 and U.S. Pat. No. 5,629,125, doped with europium and codoped with samarium as in U.S. Pat. Nos. 5,422,220 and 5,547,807 and even mixtures of tantalates and fluorohalides as in U.S. Pat. No. 5,077,145 and EP-A 0 533 234, replacing $CaWO_4$ as representative for an older well-known generation of luminescent phosphors.

In EP-A 0 820 069 particles of niobium doped, monoclinic M, yttriumtantalate phosphor and particles of an europium doped bariumfluorohalide phosphor are composing the screen.

Specific intensifying screens emitting green radiation have further been disclosed in GB-A 1,489,398; and in U.S. Pat. Nos. 4,431,922 and 4,710,637. A typical green emitting phosphor used therein is a gadolinium oxisulphide phosphor, just as the preferred phosphor used in the screen of the film/screen combination according to the present invention. In the film/screen combination sensitive to green light the pair of supported or self-supporting X-ray intensifying screens essentially consists of luminescent phosphor particles emitting at least 50% and more preferably at least 80% of their emitted radiation in the wavelength range between 540 and 555 nm, wherein said luminescent particles have a composition according to the formula (VIII)

$$Gd_2O_2S:Tb \quad \text{(VIII)}$$

The photographic elements are thus exposed with UV/blue or green light, generated by luminescence of UV/blue or green light emitting phosphors coated in the luminescent or intensifying screens disclosed hereinbefore and held in contact during exposing with X-rays the film/screen system of the present invention.

Assemblies providing means for reducing cross-over to less than 10% for radiation longer than 300 nm in wavelength have been described e.g. in U.S. Pat. No. 5,259,016. So in one embodiment double-side coated film materials may be coated at one side with an emulsion comprising {111} green-sensitized tabular grains doped with metal ion complexes according to the formula (I), wherein that side is in contact during exposure with a luminescent screen comprising green-emitting phosphors, whereas the other side is coated with an emulsion comprising {111} UV/blue-sensitized tabular grains doped with metal ion complexes according to the formula (I), wherein that side is in contact during exposure with a luminescent screen comprising UV/blue-emitting phosphors. Combinations are thus possible wherein at both sides of the film support the same or differently spectrally sensitized emulsions are present in the light-sensitive emulsion layers. Mixtures of UV/blue and green emitting phosphors may be present in one or both light-emitting screens after X-ray irradiation, wherein on the side in contact with those screens having mixed phosphors emulsions spectrally sensitized to the UV/blue and/or green part of the wavelength spectrum said emulsions may be present in one layer or in adjacent light-sensitive layers. In case wherein they are present as mixtures it is possible that these mixtures are prepared as mixture of individually prepared and individually spectrally sensitized grains or as a result of spectral sensitization of an emulsion with a mixture of UV/blue and green sensitizing dyes as has e.g. been described in EP-A 0 953 867.

Such screen/film assemblies may be in favour e.g. of a desired curve form, of a reduced cross-over percentage and/or reduced graininess.

According to the present invention a method of forming a radiographic image has also been provided, said method comprising the steps of

- exposing to X-ray irradiation a screen/film system as disclosed hereinbefore followed by
- processing the film in a processor, said processing comprising the steps of developing, fixing, rinsing and drying.

For processing the exposed film, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of

- developing said material in a developer without hardening agent;
- fixing said material in a fixer, optionally without hardening agent;
- rinsing and drying said material.

A normally used configuration in the processing apparatus shows the following consecutive tank units corresponding with, as consecutive solutions: developer-fixer-rinse water.

Recent developments however have shown, that from the viewpoint of ecology and especially with respect to reduction of replenishing amounts, as consecutive solutions the sequence developer-fixer-fixer-rinse water-rinse water is preferred. One washing step between developing and fixing and one at the end before drying may also be present.

As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342.

Especially preferred developers comprising ecologically acceptable developing agents such as ascorbic acid and derivatives thereof have been described in EP-A 0 732 619 and in U.S. Pat. Nos. 5,593,817 and 5,604,082.

Instead of or partially substituting (e.g. in a ratio by weight of from 1:1 up to 9:1) the ecologically questionable "hydroquinone" (iso)ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented and which are therefore incorporated herein by reference.

In order to reduce "sludge formation" which is favoured by solubilizing agents like sulphites, present in the developer as preservatives, a particularly suitable developer solution is the one comprising a reduced amount of sulphite and ascorbic acid which acts as a main developer and antioxidant as well and which is called low-sludge" developer.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odourless.

If however aluminum ions are present in the fixer composition for whatever a reason, the presence of α-ketocarboxylic acid compounds is recommended as has been described in EP-A's 0 620 483, 0 726 491 and in RD 16768, published March 1978. In the particular embodiment wherein rinsing between developing and fixing is excluded a method of processing an exposed black-and-white silver halide light-sensitive photographic material has been disclosed in EP-A 0 908 764, said method comprising the steps of developing in a developer solution, followed by fixing in a fixer solution, comprising a hardening agent, preferably a compound providing aluminum ions, and wherein, in running equilibrium conditions, said fixer solution has a pH of at least 4.3, further followed by rinsing and drying,; characterized in that said developing step is performed in a developer comprising, in an amount of from 5 g up to 100 gram per litre, (iso)ascorbic acid, 1-ascorbic acid or tetramethyl reductic acid as a developing agent, a precursor and/or a metal salt thereof. In a preferred embodiment a compound having an α-ketocarboxylic acid structure in an amount of not more than 3 g per litre is present in the said fixer solution while starting processing or in the said fixer replenisher.

It is further possible to use sodium thiosulphate as a fixing agent, at least partially as described in U.S. Pat. No. 5,275,923, in order to maintain rapid fixing ability, thus avoiding an excess of the ecologically undesired but normally used ammonium ions. For low coating amounts of emulsion crystals rich in chloride a fixation time which is reduced to about 2 to 10 seconds can be attained. Moreover regeneration is kept to a minimum, especially in the processing of materials coated from very low amounts of emulsion crystals rich in silver chloride. Preferred minimum regeneration or replenishment amounts are from 20 to 200 ml/m$^2$, more preferred from 20 to 100 ml/m$^2$ and still more preferred from 20 to 50 ml/m$^2$ of developed material. Materials coated from higher amounts of silver will require the higher amounts of replenisher but in most practical cases replenishment amounts of less than 200 ml/m$^2$ are attainable.

Replenishment of a developer comprising ascorbic acid or derivatives thereof and a 3-pyrazolidone derivative has been described in EP-A 0 573 700, wherein a method is disclosed for processing, with constant activity, of an image-wise exposed silver halide photographic material comprising the steps of developing photographic material in a continuous automatic way by means of a developing solution containing an ascorbic acid analogue or derivative and a 3-pyrazolidone derivative as developing agents and replenishing said developing solution by means of at least one replenishing solution having a higher pH than the developing solution. In an alternative method the replenisher is added as a powder. Other references related therewith are EP-A 0 552 511; U.S. Pat. No. 5,503,965 and further in EP-A 0 660 175, wherein a method of replenishment control is described. For the fixer preferred minimum regeneration or replenishment amounts are also from about 20 to 200 ml/m$^2$, more preferred from 20 to 100 ml/m$^2$ and still more preferred from 20 to 50 ml/m$^2$ of developed material. When aluminum ions are present in the fixer solution in order to effect hardening, it is necessary to adjust the pH of the fixer in the range from 4.2 to 4.6 in order to get the highest hardening reactivity and to suppress swelling with washing water in the washing or rinsing step. For hardened materials having a swelling degree of the hydrophilic layers of less than 250% and more preferably of less than 200% it is not required for the fixer pH to held constant in the pH range from 4.2 to 4.6 as mentioned hereinbefore: in order to reduce irritating smell from sulphite ions in aqueous acidic medium which lead to sulphur dioxide vapour it is recommended to enhance pH to a value of 4.65 up to 5.00. A process whereby the quality of the fixer remains at an optimum level has been described in EP-A 0 872 764.

Although it is possible to use whatever a processing unit adapted to the requirements described hereinbefore to reach the objectives concerning a perfect link between rapid processing and ecology, the objects of the present invention concerning processing have e.g. been realized in the processing unit CURIX HT 530, trade name product marketed by Agfa-Gevaert.

New developments however become available with respect to processing apparatus. In a conventional processing apparatus the sheet material is transported along a generally horizontal feed path, the sheet material passing from one vessel to another usually via a circuitous feed path passing under the surface of each treatment liquid and over dividing walls between the vessels. However, proces-sing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus. In a vertically oriented apparatus, it is important to avoid, or at least minimize leakage of treatment liquid from one vessel to another and carry-over as the sheet material passes through the apparatus. Furthermore it is desirable that the treatment liquid in one vessel is not contaminated by contents of the adjacent vessels, that is neither by the treatment liquid of the next higher vessel nor by vapours escaping from the next lower vessel. In order to reduce consumption of treatment liquids, it is furthermore desirable to reduce the evaporation, oxidation and carbonization thereof. A solution therefore has been proposed in EP-A 0 744 656, wherein it has been disclosed that contamination and evaporation, oxidation and carbonization can both be reduced in a simple manner by a particular construction of the apparatus for the processing of photographic sheet material comprising a plurality of cells mounted one above the other in a stack to define a substantially vertical sheet material path through the apparatus, each cell comprising a housing within which is mounted a rotatable roller biased towards a reaction surface to define a roller nip there-between through which the sheet material path extends and associated sealing means serving to provide a gas- and liquid-tight seal between the roller and reaction surface on the one hand and a wall of the housing on the other. According to a first aspect, invention is characterized by means for connecting each cell to adjacent cells in the stack in a closed manner and according to a second aspect, the invention is characterized in that the roller is a drive roller.

Particularly the objectives set forth above may be achieved when the developing cell of the apparatus is a closed cell and the developing liquid contains an ascorbic acid developing agent as has been described in EP-Application No. 96201753, filed Jun. 24, 1996. According to that invention, there is provided a method of processing photographic sheet material by making use of an apparatus comprising a plurality of processing cells arranged in order to define a sheet material path through the apparatus, at least one of the cells constituting a developing cell containing a developing liquid, characterized in that the developing cell is a closed cell and the developing liquid contains an ascorbic acid developing agent.

With respect to further characteristics of the processing apparatus we refer to EP-A 0 819 992, wherein it was an object to provide an apparatus in which operating components can easily be replaced without the need for substantial re-programming of the CPU. This could be achieved when information concerning characteristics of each operating component is stored in separate memory means.

A multi-component apparatus was thus provided comprising a plurality of operating components selected from output operating components, input operating components and combinations thereof, and a central processing unit operatively linked to said operating components, said central processing unit containing information concerning at least one desired operating sequence for said apparatus, characterized in that information concerning characteristics of each said operating component is stored in separate memory means. The programme which is typically carried in the CPU, is now seen as comprising two separable elements. Information concerning the desired function of the apparatus, i.e. logical data, such as the speed of sheet material through the apparatus, or the volume of liquid being pumped to vessels of the apparatus per unit time, continues to be stored in the CPU. Information concerning the characteristics of the operating components and their location, is separately stored for each operating component. The separate memory means is removable: when the service engineer removes a given operating component, he also removes the store of characteristics information pertaining to that operating component. As he replaces the removed operating component with a new one, he also provides a new information store, containing the characteristics information pertaining to the new operating component. Need for re-programming of the CPU is therefore avoided. The new information store is created off-site, for example as the new operating component is manufactured. In an alternative embodiment, the separate memory means is not removable, but is arranged to be by-passed or even re-programmed by the service engineer. Re-programming of the separate memory means is simpler than re-programming of the CPU. Improvements of that invention lie not only in the improved servicing characteristics but also in the quality assurance of replacement components.

As a rule, a processing apparatus for photographic sheet material comprises several treatment cells, most or all of which are in the form of vessels containing a treatment liquid, such as a developer, a fixer or a rinse liquid. As used herein, the term "sheet material" includes not only photographic material in the form of cut sheets, but also in the form of a web unwound from a roll. The sheet material to be processed is transported along a sheet material path through these vessels in turn, by transport means such as one or more pairs of path-defining drive rollers, and thereafter optionally to a drying unit. The time spent by the sheet material in each vessel is determined by the transport speed and the dimensions of the vessel in the sheet feed path direction.

From time to time it is necessary to clean the processing apparatus, in order to remove debris which may derive from the sheet material itself and deposits derived from the treatment liquids. The usual process for cleaning a processing apparatus, whether of the vertical or horizontal configuration, is to drain the treatment liquids and to flush the apparatus through with cleaning liquid. Water, optionally containing various additives and optionally at an elevated temperature, is the usual cleaning liquid. Therefore it has ever been an object to provide an apparatus in which the path-defi-ning rollers can be separated from each other in the open position, in a simple and convenient manner. The way in which this can be achieved has been described in EP-A 0 916 111, wherein the path-defining rollers are supported by bearings carried by eccentric sleeves which are stationary in the closed position, and where means are provided for partly rotating the sleeves thereby to withdraw the path-defining rollers from each other into the open position. A sheet material processing apparatus has thus been provided, comprising at least one treatment cell, a pair of rotatable path-defining rollers defining a sheet material path through the cell, the path-defining rollers having a closed position in which the path-defining rollers are biased into contact with each other to form a nip through which the sheet material path extends and an open position in which the path-defining rollers are spaced from each other, characterized in that the path-defining rollers are supported by bearings carried by eccentric sleeves which are stationary in the closed position, and means are provided for partly rotating the sleeves thereby to withdraw the path-defining rollers from each other into the open position.

Rapid ecological processing (with e.g. ascorbic acid and/or derivatives thereof as developing agent(s) in a hardener-free developer and an odour-free fixer, optionally free from aluminum ions, thereby reducing sludge; and replenishing amounts for developer and fixer as low as possible, i.e. from about 20 ml/m$^2$ up to at most 200 ml/m$^2$ and even more preferably up to 100 ml/m$^2$) may thus occur in combination with a processing unit, provided that with minimum amounts of silver coated (total amount, expressed as an equivalent amount of silver nitrate of less than 4 g per m$^2$ and per side) a sufficient covering power is attained in the film material and provided that an optimal relationship is attained between sensitometry and image quality, especially sharpness, thanks to low cross-over exposure, without residual colour (dye stain), thus providing a good image tone.

Having described in detail preferred embodiments of the present invention it is understood by a person skilled in the art that, within the scope of the present invention, it is not limited thereto.

EXAMPLES

While the present invention will hereinafter be described in connection with preferred embodiments thereof, it will be understood that it is not intended to limit the invention to those embodiments.

Emulsion A1–A3 (tabular silver chloroiodide emulsion: comparative examples)

The following solutions were prepared:

- 5.72 1 of a dispersion medium (C) containing 0.47 moles of sodium chloride, 100 g of inert gelatin and 360 mg of adenine; temperature was established at 55° C. and pH was maintained at a value of 6.0;
- a 2.94 molar silver nitrate solution (A);
- a solution containing 2.756 moles of sodium chloride, 0.015 moles of potassium iodide and 420 mg of adenin (B1).

A nucleation step was performed by introducing solution A and solution B1 simultaneously in dispersion medium C, both at a flow rate of 70 ml/min, during 30 seconds at a stirring rate of 500 r.p.m. After a physical ripening time of 20 min during which the temperature was raised to 70° C., a first growth step was performed. This was done by introducing in the reaction vessel during 29 minutes solution A and B1 by double jet addition: solution A, starting at a flow rate of 10.0 ml/min and linearly increasing the flow rate to an end value of 27.4 ml/min, solution B1 at an increasing flow rate in order to maintain a constant mV-value of +115 mV (pAg=7.16) measured by a silver electrode versus a Ag/AgCl Ingold reference electrode. Then a second growth step was started after a physical ripening time of 5 minutes by introducing, during 26 min and 27 sec, by double jet: solution A, maintaining first during 4 min a flow rate of 10.0 ml/min, then increasing the flow rate linearly to an end value of 19.80 ml/min; solution B1 at a flow rate in order to maintain a constant mV-value of 135 mV (pAg=6.86). Finally, an amount of a potassium iodide solution 0.37 N was added to this dispersion medium in order to get a total amount of iodide of 1 mole %. After cooling the emulsion to about 40° C., 24 ml of polystyrene sulphonic acid was added, and the pH value of the said dispersing medium was adjusted to a value of 3.0. The emulsion was flocculated, decanted and washed three times with an amount of 4 l of demineralized water in order to remove the soluble salts present.

The Emulsion A1 thus obtained was consisting of 91% of tabular grains, by number, having 2 parallel {111}-faces. The crystals were characterized by an average aspect ratio of 6.2, an average circular diameter of 0.75 μm and an average sphere equivalent diameter dM of 0.68 μm. Said average sphere equivalent diameter represents the average diameter of a circle, calculated from spheres having an equivalent volume as the corresponding tabular grains. The silver halide composition was represented as AgCl(99%)I(1%).

In the same way Emulsion A2 was prepared, except for the addition of 29.4 ml of a solution of 104.7 mg of $K_4Ru(CN)_6$ in 250 ml of demineralized water to solution D1, wherein 29.4 ml of demineralized water was replaced by the said solution D1. The dopant thus added was divided homogenously over the entire volume of the silver chloroiodide crystals.

Emulsion A3 was prepared in order to concentrate the $Ru(CN)_6^{4-}$ complex ions in a band between precipitation of 80% and 95% of the total amount of silver. Therefore 29.4 ml of the solution used in order to prepare Emulsion A2 described hereinbefore was added via a separate inlet during the time between which 80 and 95% of the total amount of silver halide were precipitated.

For Emulsions A2 and A3 amounts of $Ru(CN)_6^{4-}$ of $10\times10^{-6}$ mole per mole of silver were added and the average crystal diameter was only slightly varying (0.78 μm and 0.72 μm respectively) for a constant thickness:0.12 μm.

Emulsions B–F (tabular silver chloroiodide emulsion as Emulsion A but doped with metal complexes as indicated hereinafter: inventive examples)

For {111} tabular silver chloroiodide Emulsions B,C and D the tabular crystals were doped with $K_2OsF_6$ in amounts of 10, 50 and 100 p.p.m. after precipitation of 80 mole % of the total amount of silver chloride and before 95 mole % of the total amount of silver chloride was precipitated.

For {111} tabular silver chloroiodide Emulsions E and F the tabular crystals were doped with $K_2IrF_6$ in amounts of 10 and 50 p.p.m. after precipitation of 80 mole % of the total amount of silver chloride and before 95 mole % of the total amount of silver chloride was precipitated.

Before the start of the chemical ripening the mV-value of every redispersed emulsion A–F was adjusted at +120 mV with sodium chloride and the pH-value at 5.5 with sodium hydroxide. As a green spectral sensitizer anhydro-5,5'-dichloro-3,3'-bis-(n-sulphobutyl)-9-ethyl-oxacarbo-cyanine was added in an amount of 1.25 mmole per mole of silver. As chemical ripening agents, added after the spectral sensitizer, gold thiocyanate and sodium thiosulphate as a source of sulphur were added, whereas toluene thiosulphonic acid was used as predigestion agent. The amounts of each chemical ripening were optimized in order to obtain an optimal fog-sensitivity relationship after 2 hours at 57° C.

Before coating each emulsion was stabilized with 1-p-carboxy-phenyl-5-mercaptotetrazole and after addition of the normal coating additives the solutions were coated simultaneously together with a protective layer containing 1.3 g gelatine per $m^2$ per side on both sides of a polyethylene terephthalate film support having a thickness of 175 μm. The resulting photographic material contained per side an amount of silver halide corresponding to 3.5 grams of silver per $m^2$ and an amount of gelatin corresponding to 2.80 g/$m^2$.

Samples of these coatings were exposed with green light of 540 nm during 0.1 seconds using a continuous wedge and were processed.

The processing was run in the developer A the composition of which is given hereinafter, followed by fixing in fixer A' (see composition given hereinafter) and rinsing at the indicated temperature of 35° C. for a total processing time of 45 seconds.

| Developer A | | |
|---|---|---|
| 1-phenyl-4-methyl-4'hydroxy-methyl-pyrazolidine-3-one | 2 | g/l |
| Sodium EDTA | 2 | g/l |
| Potassium bromide | 3.3 | g/l |
| Potassium thiocyanate | 1 | g/l |
| Potassium sulphite | 33 | g/l |
| Potassium carbonate | 96 | g/l |
| Polyglycol (M.W. = ca. 400) | 20 | ml/l |
| Compound (x) | 1 | g/l |
| Ascorbic Acid | 50 | g/l |
| pH ready-for-use | 10.0 | |
| Fixer A' | | |
| Ammonium thiosulphate (60% solution, wherein 1 ml comprises 0.778 g) | 710 | ml |
| Sodium metabisulphite | 80 | g |
| Sodium acetate | 130 | g |
| Acetic acid | 31 | ml |
| pH ready-for-use (after dilution 1 + 3) | 4.90 | |

In Table 4 the sensitometric results obtained are given.

The density as a function of the light dose was measured and therefrom were determined the following parameters:

fog level F (with an accuracy of 0.001 density), the relative speed S at a density of 1 above fog (an increase of the said speed with a factor of 2 gives a speed value that is 0.30 lower as the relation is logarithmic and as less light is needed to get the desired density), the contrast expressed as gradation G1, calculated between the densities 0.1 and 1.0 above fog, the contrast expressed as gradation G2, calculated between the densities 0.25 and 2.0 above fog, diagnostic value (DV):+=satisfying;−=bad.

TABLE 4

| Emulsion | F | S | G1 | G2 | DV |
|---|---|---|---|---|---|
| A1 (comp.) | 0.041 | 1.76 | 2.19 | 3.67 | + |
| A2 (comp.) | 0.054 | 1.62 | 2.16 | 3.78 | + |
| A3 (comp.) | 0.042 | 1.58 | 2.12 | 3.68 | + |
| B (inv.) | 0.070 | 1.69 | 2.13 | 3.93 | + |
| C (inv.) | 0.060 | 1.60 | 1.96 | 3.45 | + |
| D (inv.) | 0.080 | 1.57 | 2.26 | 4.04 | + |
| E (inv.) | 0.150 | 1.60 | 1.82 | 3.42 | + |
| F (inv.) | 0.100 | 1.35 | 2.04 | 4.34 | + |

From Table 4 it can be concluded that the presence of SET's within part of the volume of the {111} tabular emulsion grain as becomes clear from the precipitation scheme of said grain is required for sensitivity and that the choice and the amount of dopant is decisive for the result obtained. Only minor changes in image contrast and fog level are obtained due to the introduction of the dopants. Sensitivity has thus clearly been increased, while diagnostic properties have been judged to remain about the same.

Having described in detail preferred embodiments of the current invention, it will now be apparent to those skilled in the art that numerous modifications can be made therein without departing from the scope of the invention as defined in the appending claims.

What is claimed is:

1. Light-sensitive {111} tabular silver chlor(oiod)ide emulsion comprising a binder and silver chlor(oiod)ide crystals having at least 90 mole % of silver chloride, accounting for at least 50% of total protective surface of said crystals, having an average thickness of less than 0.3 $\mu$m, an average crystal diameter of more than 0.5 $\mu$m and an average aspect ratio of more than 2:1, wherein said tabular crystals have been spectrally sensitized with blue and/or green spectral sensitizers and have been doped with at least one of a hexacoordinated metal ion complex represented by formula (I)

$$[ML_{6-n}F_n]^{m-} \quad \text{(I)}$$

wherein n is an integer having a value of at least 4, wherein m is an integer having a value of 1, 2, 3 or 4, wherein M represents a metal selected from the group consisting of Ir, Os and Pt, and wherein L represents a ligand selected from the group consisting of Cl, Br and I; and wherein said at least one of said metal ion complexes is present in an annular ring and wherein in said annular ring said ion complex ion(s) is(are) present in an amount of from $1\times10^{-6}$ up to $1000\times10^{-6}$ mole per mole of silver.

2. Emulsion according to claim 1, wherein in said tabular crystals at least one hexafluoro-coordinated metal ion complex (wherein n=6 in formula (I)) is present.

3. Emulsion according to claim 1, wherein in said tabular crystals at least one of said metal ion complexes is present in an amount of up to $10^{-4}$ mole per mole of silver.

4. Emulsion according to claim 1, wherein in said tabular crystals said annular ring is present within 95 mole % of a total amount of precipitated silver halide.

5. Emulsion according to claim 1, wherein said silver silver chlor(oiod)ide crystals have at least 95 mole % of silver chloride.

6. Emulsion according to claim 1, wherein said silver silver chlor(oiod)ide crystals have at least 99 mole % of silver chloride.

7. Material having coated on at least one side of a support at least one light-sensitive silver halide emulsion layer comprising an emulsion according to claim 1.

8. Screen/film system having in operative association with a material according to claim 7, at one or both sides thereof, an intensifying screen comprising luminescent phosphors emitting UV/blue and/or green light.

* * * * *